US009163501B2

(12) United States Patent
Siepenkort et al.

(10) Patent No.: US 9,163,501 B2
(45) Date of Patent: Oct. 20, 2015

(54) GUIDE PIECE FOR AN EXTRACTION OR COAL PLOUGH

(71) Applicant: Caterpillar Global Mining Europe GmbH, Lünen (DE)

(72) Inventors: Gerhard Siepenkort, Lüngen (DE); Norbert Hesse, Bochum (DE); Klaus Duhnke, Werne (DE); Uwe Tillessen, Kamen (DE)

(73) Assignee: Caterpillar Global Mining Europe GmbH, Lunen (DE)

( * ) Notice: Subject to any disclaimer, the term of this patent is extended or adjusted under 35 U.S.C. 154(b) by 0 days.

(21) Appl. No.: 14/212,642

(22) Filed: Mar. 14, 2014

(65) Prior Publication Data

US 2015/0260040 A1 Sep. 17, 2015

(51) Int. Cl.
*E21C 35/12* (2006.01)

(52) U.S. Cl.
CPC ..... *E21C 35/12* (2013.01)

(58) Field of Classification Search
CPC ..... E21C 35/12
See application file for complete search history.

(56) References Cited

U.S. PATENT DOCUMENTS

| | | | | |
|---|---|---|---|---|
| 4,715,659 | A * | 12/1987 | Rassmann et al. | 299/43 |
| 5,040,850 | A * | 8/1991 | Komotzki | 299/106 |
| 5,704,267 | A * | 1/1998 | Merten et al. | 83/823 |
| 7,097,256 | B2 | 8/2006 | Tillessen et al. | |
| 7,343,947 | B1 * | 3/2008 | Sollami | 144/241 |

FOREIGN PATENT DOCUMENTS

| | | |
|---|---|---|
| DE | 3309188 | 9/1984 |
| DE | 3711105 A1 | 10/1988 |
| DE | 202004001301 U1 | 5/2004 |
| DE | 202009000787 | 6/2010 |
| GB | 1145247 | 3/1969 |
| WO | 2010084427 A1 | 7/2010 |

* cited by examiner

*Primary Examiner* — John Kreck

(57) ABSTRACT

A replaceable guide piece (10) for an extraction or coal plough (100) is provided. The replaceable guide piece (10) includes a generally U-shaped guide piece body (12) configured to be inserted into a guide claw (14) of the plough (100). A single recess (22) is formed in a central portion of a guide piece body (12) to extend at an angle (α) from an upper side of guide piece body (12) to a side surface of the same. A locking mechanism (24) is configured to engage with the single recess (22) to prevent movement of the guide piece (10) in the longitudinal direction after insertion of the guide piece (10) into the guide claw.

18 Claims, 2 Drawing Sheets

GUIDE PIECE FOR AN EXTRACTION OR COAL PLOUGH

TECHNICAL FIELD

The present disclosure generally relates to mining machines for underground mining and, more particularly, to a guide piece for an extraction or coal plough.

BACKGROUND

In underground mining, a so-called extraction or coal plough is used for extracting, for example, coal in a coalmine. Such an extraction or coal plough is generally supported on a conveyer laid out before a coal head. The conveyer includes a plough guide attached to a side profile of the conveyer. The plough guide includes a guide rail on the upper side of the same, and the plough is guided on the guide rail by a pair of guide claws engaged with the guide rail.

A guide piece is provided between each guide claw of the plough and the guide rail. The guide pieces are detachably attached to the guide claws of the plough and can be replaced after having been subjected to wear. U.S. Pat. No. 7,097,256 B2 shows an example of a guide piece that slides on a guide rail.

The disclosed systems and methods are directed at least in part to improving known systems.

SUMMARY OF THE DISCLOSURE

In one aspect, the present disclosure relates to a guide piece for a extraction or a coal plough. The guide piece comprises a generally U-shaped guide piece body configured to be inserted into a guide claw of the plough along an insertion direction. The guide piece body includes a first leg, a second leg and a connection portion extending between the first leg and the second leg. A recess is formed in the guide piece body to extend at an angle with respect to the connecting portion from an outer side of the connecting portion to an outer side of one of the first leg and the second leg. The recess is configured for engagement with a locking mechanism to prevent movement of the guide piece at least in a direction opposite to the insertion direction after installation of the guide piece in the guide claw.

In another aspect, the present disclosure relates to a locking mechanism for a guide piece for an extraction or coal plough. The guide piece is configured to be inserted into a guide claw of the plough along an insertion direction. The locking mechanism comprises a bolt configured to be received in a receiving bore formed in the guide claw and in a recess formed in the guide piece after installation of the guide piece in the guide claw. The bolt further includes an inner bore and an annular groove disposed adjacent to a first end of the bolt. A securing mechanism is configured for engagement with the annular groove when the bolt is received in the receiving bore and the recess to secure the bolt in the receiving bore, to thereby prevent movement of the guide piece at least in a direction opposite to the insertion direction.

In yet another aspect of the present disclosure, a guide piece assembly for extraction of a coal plough comprises a guide piece and a locking mechanism. The guide piece comprises a generally U-shaped guide piece body configured to be inserted into a guide claw of the plough along an insertion direction. The guide piece body includes a first leg, a second leg and a connection portion extending between the first leg and the second leg. A recess is formed in the guide piece body to extend at an angle with respect to the connecting portion from an outer side of the connecting portion to an outer side of one of the first leg and the second leg. The locking mechanism comprises a bolt configured to be received in a receiving bore formed in the guide claw and in a recess formed in the guide piece after installation of the guide piece in the guide claw. The bolt further includes an inner bore and an annular groove disposed adjacent to a first end of the bolt. A securing mechanism is configured for engagement with the annular groove when the bolt is received in the receiving bore and the recess to secure the bolt in the receiving bore, to thereby prevent movement of the guide piece at least in a direction opposite to the insertion direction Other features and aspects of the present disclosure will be apparent from the following description and the accompanying drawings.

DETAILED DESCRIPTION

The following is a detailed description of exemplary embodiments of the present disclosure. The exemplary embodiments described herein are intended to teach the principles of the present disclosure, enabling those of ordinary skill in the art to implement and use the present disclosure in many different environments and for many different applications. Therefore, the exemplary embodiments are not intended to be, and should not be considered as a limiting description of the scope of protection. Rather, the scope of protection shall be defined by the appended claims.

The present disclosure may be based in part on the realization that, when a guide piece is to be attached to a guide claw of a plough, it is desirable to provide a mechanism for attaching the guide piece that allows use of a guide piece having a relatively short length in the direction of insertion, i.e., the longitudinal direction of the guide piece. This is because, when a mechanism is used where the guide piece is attached to the guide claw at several positions along the longitudinal direction, the guide claw has to be provided with a greater length in the longitudinal direction, resulting in an increase in the loading height during an extraction operation of the plough. The guide piece disclosed herein allows for a shorter guide piece and, correspondingly, a shorter guide claw, resulting in an increase in a space that is available during a loading operation.

Further, the present disclosure may be based in part on the realization that, when a guide piece inserted in a guide claw of a plough has to be periodically replaced during operation of the plough, it is desirable to allow for a quick and easy replacement of the guide piece. According to the present disclosure, this is achieved by fixing the guide piece to the guide claw at a single position in the longitudinal direction, i.e., by a single locking mechanism holding the guide piece in place in the longitudinal direction. With the disclosed locking mechanism, the guide piece can be easily detached from the guide claw without having to, for example, loosen a plurality of nuts and bolts.

Figure 1:
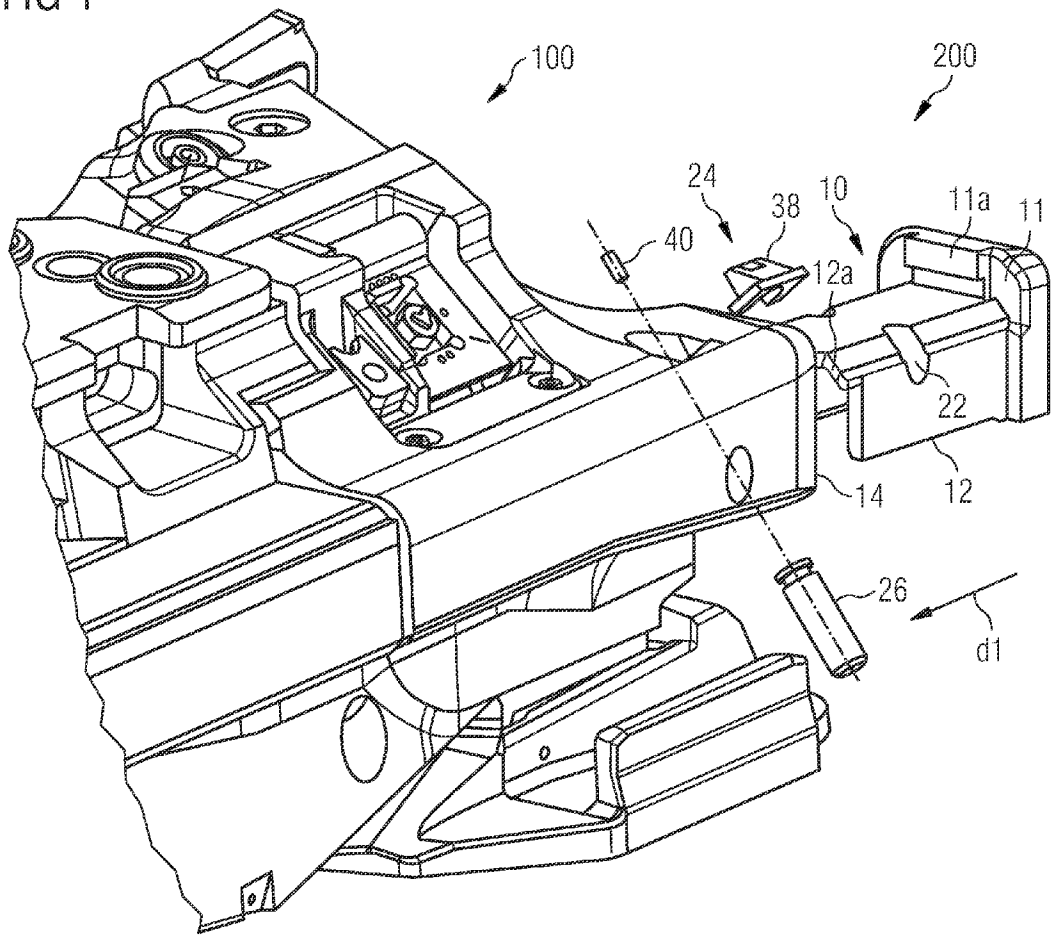
FIG. 1 shows an assembly view of a guide piece to be inserted into a guide claw of a plough according to an exemplary embodiment.

Referring now to the drawings, FIG. 1 shows an assembly view of a guide piece 10 to be installed in a guide claw 14 of an extraction or coal plough 100.

As shown in FIG. 1, plough 100 includes guide claw 14 formed on a side of the same. It will be readily appreciated that a second identical guide claw may be formed on an opposite second end of plough 100. Guide claw 14 defines an inner space for receiving guide piece 10 when guide piece 10 is inserted into guide claw 14 along an insertion direction d1 from outside of plough 100. In particular, inner surface of guide claw 14 may be configured to include one or more support structures for supporting guide piece 12 when it is inserted into guide claw 14, thereby positively supporting guide piece 12 inside guide claw 14. In addition, a stop may be provided inside guide claw 14 to define an end position of guide piece 10 in guide claw 14. In some embodiments, no stop may be provided inside guide claw 14, and the end position of guide piece 10 may be defined by a stop 11 formed as a projection on one end of guide piece 10 as shown in FIG. 1.

As shown in FIG. 1, guide piece 10 includes a generally U-shaped guide piece body 12 configured to be inserted into guide claw 14 of plough 100 along insertion direction d1. Guide piece 12 may be configured to be positively supported at least in part in guide claw 14 by the afore-mentioned support structures. For example, a first projection 11*a* may be formed on stop 11 to project in the direction of insertion d1, and a second projection 12*a* may be formed to project from the opposite end of guide piece body 12, for example, also in the direction of insertion d1. First and second projections 11*a*, 12*a* may be configured to engage corresponding support structures formed in or on guide claw 14. For example, first projection 11*a* may be configured to engage an outer edge of guide claw 14, and second projection 12*a* may be configured to engage with a groove or the like formed inside guide claw 14. It will be readily appreciated that in other embodiments different configurations may be used to support at least in part guide piece 10 inside guide claw 14 when guide piece 10 is inserted into guide claw 14.

Figure 2:
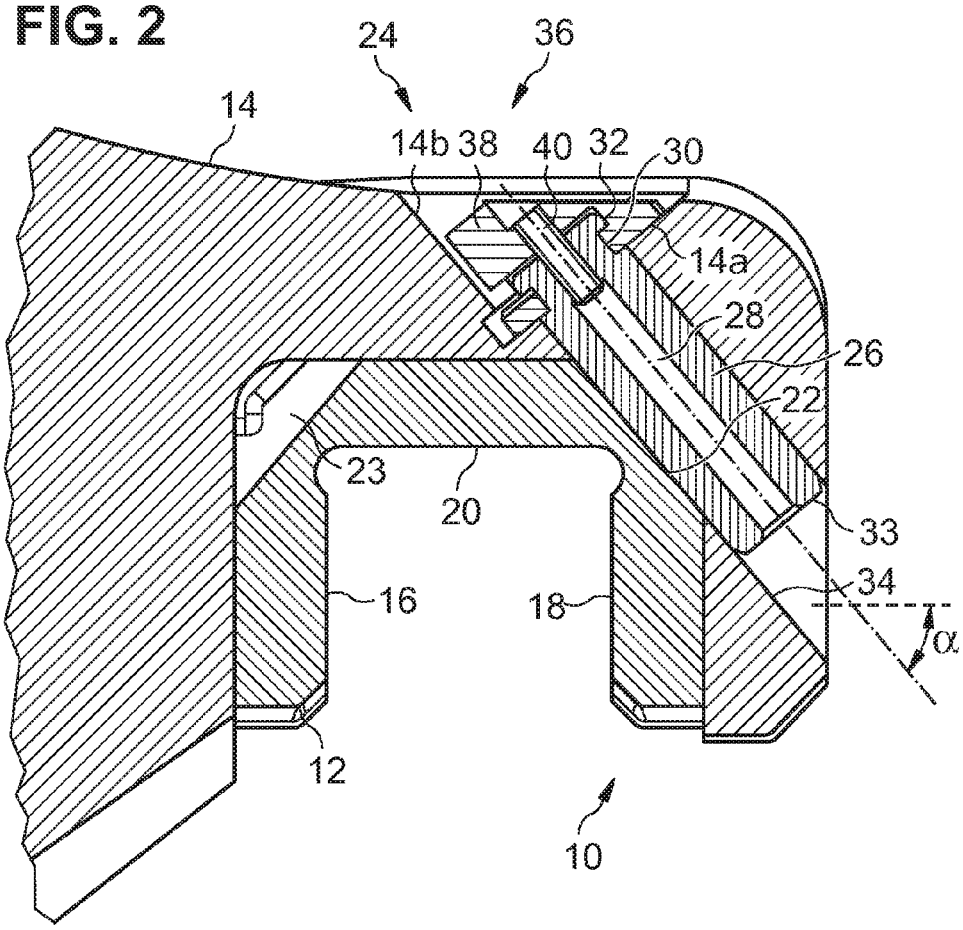
FIG. 2 shows a sectional view of the guide piece of FIG. 1 installed in the guide claw and secured to the same.

U-shaped guide piece body 12 includes a depending first leg 16, a depending second leg 18 and a plane connecting portion 20 extending between first leg 16 and second leg 18 (see also FIG. 2). Further, guide piece body 12 includes a recess 22 formed in guide piece body 12. Recess 22 extends at an angle α (see FIG. 2) with respect to plane connecting portion 20 from an outer side of connecting portion 20 to an outer side of one of first leg 16 and second leg 18 (in the example shown in FIG. 2, recess 22 is formed to extend from connecting portion 20 to second leg 18). In some embodiments, angle α may be between around 30° and around 60°, for example, around 45°. However, in other embodiments, different angles may be used.

It will be readily appreciated that, in order to allow use of the same guide piece 10 for the guide claw formed on the opposite side of plough 100, guide piece 10 may have a symmetrical configuration, i.e., may comprise another recess (a second recess) 23 which may have substantially the same configuration as that of recess 22 and may be formed on the opposite side of guide piece 10, i.e., additional recess 23 may extend from connecting portion 20 to first leg 16 in the same manner as recess 22 extends from connection portion 20 to second leg 18 (see FIG. 2).

Recess 22 is configured for engagement with a locking mechanism 24 after having been inserted into guide claw 14 to prevent movement of guide piece 10 in the insertion direction d1. As shown in FIG. 1, locking mechanism 24 includes a bolt 26, a locking member 38 and a pin 40, which will be described in more detail below. Guide piece 12 and locking mechanism 24 may form a guide piece assembly 200, as shown in FIG. 1.

Referring now to FIG. 2, locking mechanism 24 is shown in more detail. FIG. 2 shows a sectional view of guide piece 10 installed in guide claw 14 and locked in position inside guide claw 14 by locking mechanism 24.

As shown in FIG. 2, after guide piece 10 has been inserted into guide claw 14, recess 22 is aligned with a receiving bore 34 formed in guide claw 14 and extending through guide claw 14 from an upper side to a side surface of the same. In other words, as shown in FIG. 2, receiving bore 34 extends at the same angle α with respect to the outer surface of connecting portion 20 of guide piece 10 as recess 22. Accordingly, when guide piece 10 is received in guide claw 14, bolt 26 can be inserted into receiving bore 34 from above to extend through receiving bore 34 and recess 22. In this manner, movement of guide piece 10 in insertion direction d1 (see FIG. 1), i.e., in the direction perpendicular to the sectional view shown in FIG. 2 is prevented by bolt 26 inserted in recess 22. As shown in FIG. 1, recess 22 may be configured as a single recess formed on each side of guide piece body 12. For example, single recess 22 may be formed in a central portion of guide piece body 12 in the longitudinal direction of the same, which longitudinal direction corresponds to insertion direction d1, as will be readily appreciated.

In the example shown in FIG. 1, recess 22 is formed as a groove extending from the outer side of connecting portion 22 to the outer side of one of first leg 16 and second leg 18 with a curved profile. In the example, the curved profile may be a generally semi-circular profile matching the profile of bolt 26. Accordingly, guide piece 10 can be securely held in place by engagement of bolt 26 within corresponding recess 22. It will be readily appreciated, however, that in other exemplary embodiments recess 22 may be formed as a groove having a different profile. Further, it will be readily appreciated that, while recess 22 is shown in FIG. 1 as a groove having a bottom surface, in other exemplary embodiments, recess 22 may be formed to extend through guide piece body 12, i.e., may be opened toward an inner side of guide piece body 12. It is obvious that any appropriate configuration for recess 22 and corresponding bolt 26 may be used that allows fixing the position of guide piece 10 in the longitudinal direction by engagement of bolt 26 with recess 22.

Returning now to FIG. 2, attachment of bolt 26 inside receiving bore 34 and recess 22 will be described in more detail. As shown in FIG. 2, bolt 26 includes a first end 32 and an opposite second end 33, and an inner bore 28 extending through bolt 26 from first end 32 to second end 33. In the exemplary embodiment shown in FIG. 2, inner bore 28 includes a first portion having a first diameter adjacent to first end 32, and a second portion adjoining the first portion and having a second diameter that is greater than the first diameter. In addition, an annular groove 30 may be formed in bolt 26 adjacent to first end 32. It should be appreciated that, in other exemplary embodiments, inner bore 28 may not extend all the way through bolt 26, i.e., bolt 26 may be closed at second end 33. Further, in other embodiments, inner diameter of inner bore 28 may be constant.

Locking member 38 is configured to engage with groove 30 when bolt 26 is inserted into receiving bore 34 such that a side wall of groove 30 disposed toward second end 33 is aligned with an abutment surface 14*a* defining receiving bore 34 of claw 14. By engagement of locking member 38 with annular groove 30 in this position, further movement of bolt 36 into receiving bore 34 is prevented.

Figure 3:
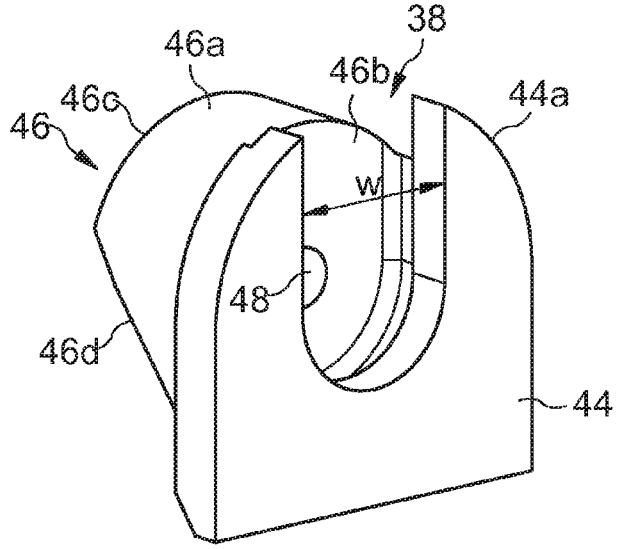
FIG. 3 shows a perspective view of a locking member of a locking mechanism for securing the guide piece to the guide claw according to an exemplary embodiment.

When locking member 38 is in engagement with annular groove 30 in the above-described manner, pin 40, which may be formed with an outer diameter that is somewhat larger than the diameter of inner bore 28 of bolt 26, may be driven into inner bore 28 by applying appropriate force, for example, using a hammer or the like, through a locking member inner bore 48 (see FIG. 3). To allow expansion of bolt 26, one or more cutouts or the like may be provided in first end 32 of bolt 26. In this manner, bolt 26 may be expanded in the region where pin 40 is inserted, and may therefore be secured inside receiving bore 34. In the same manner, locking member 38, in particular, a portion of locking member 38 in engagement with bolt 26 may also be expanded to secure locking member 38 to guide claw 14. As shown in FIG. 2, when locking member 38 is in engagement with bolt 26, a bottom surface of a base 44 (see FIG. 3) of locking member 38 is in engagement with abutment surface 14*a* of guide claw 14, and an arcuate surface 46*a* (see FIG. 3) is in abutment with an abutment surface 14*b* partially defining an opening in guide claw 14 into which locking member 38 is inserted. With this configuration, both locking member 38 and bolt 26 can be securely held in their position with respect to the direction of insertion of bolt 26 into receiving bore 34 by pin 40.

Referring now to FIG. 3, a configuration of an exemplary embodiment of locking member 38 is shown in more detail.

As shown in FIG. 3, locking member 38 includes a substantially flat base 44 having a cut 46 extending from an outer edge 44*a* of base 44 toward a center of the same. Cut 46 has a width w that corresponds to a diameter of bolt 26 at the position where annular groove 30 is formed. Locking member 38 further includes a head portion 46 extending from base 44. Head portion 46 includes arcuate outer surface 46*a*, a bottom surface 46*b* facing base 44 and connected to arcuate surface 46*a*, a distal end 46*c* to which arcuate surface 46*a* extends from bottom surface 46*b*, and a tapered surface 46*d* extending from distal end 46*c* to outer edge 44*a* of base 44. In addition, locking member 38 includes locking member inner bore 48 formed at least in head portion 46 and configured to receive pin 40 when pin 40 is driven into inner bore 28 of bolt 26.

Accordingly, as will be readily appreciated from FIGS. 2 and 3, base 44 of locking member 38 is configured to engage with annular groove 30 of bolt 26, and both base 44 and arcuate surface 46*a* are configured to abut against abutment surface 14*a*, 14*b* when locking member 38 is brought into engagement with bolt 26. Accordingly, locking member 38 is held in position by abutment against abutment surfaces 14*a*, 14*b* and is configured to engage with a flange at first end 32 of bolt 26 which is defined by annular groove 30 formed in bolt 26.

It will be readily appreciated that, while in the exemplary embodiment shown in FIG. 3 locking member 38 includes base 44 and head portion 46 including locking member inner bore 48, in other embodiments, locking member 38 may have a different configuration. For example, head portion 46 may be omitted, and locking member 38 may be formed by base 44 only. Any appropriate configuration can be used for locking member 38, as long as it allows for engagement with annular groove 30 of bolt 26 to limit movement of bolt 26 in the direction of insertion into receiving bore 34. Further, while in the exemplary embodiment shown in FIGS. 2 and 3 locking member inner bore 48 may be formed with the same diameter as inner bore 28 of bolt 26, in other embodiments, diameter of locking member inner bore 48 may be different from diameter of inner bore 28. Accordingly, in some embodiments, only bolt 26 may be expanded when pin 40 is driven into inner bore 28, and locking member 38 may be indirectly expanded by the expansion of first end 32 of bolt 26.

INDUSTRIAL APPLICABILITY

The industrial applicability of the systems and methods disclosed herein will be readily appreciated from the foregoing discussion. One exemplary machine suited to the disclosure is an underground mining machine such as an extraction or coal plough. It will be readily appreciated, however, that the systems and methods disclosed herein can be applied to other systems where a machine is guided on a guide rail, and guide pieces are inserted between the guide rail and a corresponding guide claw of the machine.

In accordance with some embodiments, a method of installing and/or replacing a guide piece 10 in a guide claw 14 comprises the following steps.

When guide piece 10 is to be installed in guide claw 14, guide piece 10 may be provided and inserted into an inner space formed in guide claw 14 along insertion direction d1 (see FIG. 1). Guide piece 10 may be configured to be positively supported at least in part by guide claw 14 via projections 11*a*, 11*b*. Movement of guide piece 10 in insertion direction d1 may be limited by stop 11 formed on one end of guide piece 10.

After guide piece 10 has reached its end position inside guide claw 14, recess 22 formed in guide piece body 12 is aligned with receiving bore 43 formed in guide claw 14.

In order to fix the position of guide piece 10 in the direction of insertion d1, i.e., in the longitudinal direction of guide piece 10, bolt 26 is inserted through an opening formed in the upper side of guide claw 14 into receiving bore 34 and, at the same time, into recess 22. Accordingly, movement of guide piece 10 in the longitudinal direction is prevented, such that the position of guide piece 10 in the direction of insertion d1 is fixed.

Then, locking member 38 is brought into engagement with annular groove 30 formed in first end 32 of bolt 26, limiting movement of bolt 26 inside receiving bore 34 and recess 22.

In this configuration, base 44 of locking member 38 abuts against abutment surface 14*a*, and arcuate surface 46*a* of locking member 38 abuts against corresponding abutment surface 14*b*. Next, pin 40 is driven into inner bore 28 of bolt 26. Due to pin 40 having a slightly larger diameter than the diameter of inner bore 28 of bolt 26, bolt 26 is expanded at first end 32, thereby securing bolt 26 inside receiving bore 34, and also securing locking member 38 by also expanding the same. Accordingly, bolt 26 and, consequently, guide piece 10 are securely attached inside guide claw 14.

During operation of plough 100, guide piece 10 may be worn and may need to be replaced after a certain number of operating hours. In order to replace guide piece 10, pin 40 can be driven further into bolt 26 by use of an appropriate tool, for example, a mandrel or the like. This may be facilitated by inner bore 28 being formed with a larger diameter in the portion of bolt 26 extending from annular groove 30 towards second end 33, as shown in FIG. 2. Therefore, once pin 40 has been driven past annular groove 30, pin 40 may fall out of bolt 26 at second end 33. Accordingly, second end 32 of bolt 26 will revert to its original form with a reduced diameter, and locking member 38 may be removed from bolt 26. After removal of locking member 38, bolt 26 may be removed from receiving bore 34 either through an opening formed in an outer side surface of guide claw 14 (see FIG. 1), or from the upper side of guide claw 14, i.e., bolt 26 may be pulled out from above.

Removal of bolt 26 from receiving bore 34 allows movement of guide piece 10 in the direction opposite to insertion direction d1 to be removed from guide claw 14. In this manner, guide piece 10 can be easily removed from guide claw 14 without having to loosen a plurality of nuts and bolts or the like. After removal of worn guide piece 10, a new guide piece 10 may be inserted into guide claw 14 as a replacement part in the above-described manner.

It will be appreciated that the foregoing description provides examples of the disclosed systems and methods. However, it is contemplated that other implementations of the disclosure may differ in detail from the foregoing examples. All references to the disclosure or examples thereof are intended to reference the particular example being discussed at that point and are not intended to imply any limitation as to the scope of disclosure more generally. All methods described herein may perform in any suitable order unless otherwise indicated herein or clearly contradicted by context.

Accordingly, this disclosure includes all modifications and equivalences of the subject-matter recited in the claims appended hereto as permitted by applicable law. Moreover, any combination of the above-described elements in all possible variations thereof is encompassed by the disclosure unless otherwise indicated herein or clearly contradicted by context.

Although the preferred embodiments of this disclosure have been described herein, improvements and modifications may be incorporated without departing from the scope of the following claims.

The invention claimed is:

1. A guide piece for an extraction or coal plough, comprising:

a generally U-shaped guide piece body configured to be inserted into a guide claw of the plough along an insertion direction, the guide piece body including a first leg, a second leg and a connecting portion extending between the first leg and the second leg; and a recess formed in the guide piece body to extend at an angle with respect to the connecting portion from an outer side of the connecting portion to an outer side of one of the first leg and the second leg, the recess being configured for engagement with a locking mechanism to prevent movement of the guide piece at least in a direction opposite to the insertion direction after installation of the guide piece in the guide claw.

2. The guide piece of claim 1, wherein the recess is configured as a single recess that extends from the outer side of the connecting portion to the outer side of the one of the first leg and the second leg.

3. The guide piece of claim 2, wherein the single recess is formed in a central portion of the guide piece body in a longitudinal direction of the same.

4. The guide piece of claim 1, wherein the recess is formed as groove extending from the outer side of the connecting portion to the outer side of the one of the first leg and the second leg.

5. The guide piece of claim 4, wherein the groove has a generally semi-circular profile.

6. The guide piece of claim 1, wherein the angle is between around 30° and around 60°.

7. The guide piece of claim 6, wherein the angle is around 45°.

8. The guide piece of claim 1, wherein the recess is a first recess, the guide piece further comprising a second recess formed in the guide piece body to extend at the angle with respect to the connecting portion from the outer side of the connecting portion to an outer side of the other one of the first leg and the second leg.

9. The guide of claim 8, wherein the second recess has a configuration that is substantially the same as that of the first recess.

10. The guide piece of claim 1, further comprising at least one projection formed to project from the guide piece body in the direction of insertion, the at least one projection being configured to support at least in part the guide piece in the guide claw by positive engagement with the same.

11. The guide piece of claim 10, wherein the at least one projection includes at least one of a first projection projecting from a stop formed at one end of the guide piece body to limit at least in part movement of the guide piece in the direction of insertion when the guide piece is inserted into the guide claw, and a second projection formed on the opposite end of the guide piece body to project from the same.

12. A locking mechanism for a guide piece for an extraction or coal plough, the guide piece being configured to be inserted into a guide claw of the plough along an insertion direction, comprising:

a bolt configured to be received in a receiving bore formed in the guide claw and in a recess formed in the guide piece after installation of the guide piece in the guide claw, the bolt including an inner bore and an annular groove disposed adjacent to a first end of the bolt; and a securing mechanism configured for engagement with the annular groove when the bolt is received in the receiving bore and the recess to secure the bolt in the receiving bore, to thereby prevent movement of the guide piece at least in a direction opposite to the insertion direction.

13. The locking mechanism of claim 12, wherein the securing mechanism includes a locking member and a pin, the locking member being configured to engage with the annular groove of the bolt, the pin being configured to be driven into the inner bore of the bolt to expand the bolt for securing the bolt and the locking member to the guide claw.

14. The locking mechanism of claim 13, wherein the locking member includes a substantially flat base having a cut extending from an outer edge of the base towards a center of the same, the cut having a width corresponding to a diameter of the bolt at the position where the annular groove is formed, and a head portion extending from the base, the head portion including an arcuate outer surface configured to abut against an abutment surface of the guide claw when the locking member engages with the annular groove of the bolt.

15. The locking mechanism of claim 14, wherein the head portion further includes a bottom surface facing the base, the arcuate surface extending from the bottom surface towards a distal end of the head portion, and a tapered surface extending from the distal end of the head portion to the outer edge of the base.

16. The locking mechanism of claim 15, wherein the locking member further includes a locking member inner bore formed at least in the head portion and configured to receive the pin when the pin is driven into the inner bore of the bolt.

17. The locking mechanism of claim 12, wherein the inner bore of the bolt extends through the bolt, allowing the pin to be removed from the bolt via an opening formed in a second end of the bolt opposite to the first end.

18. A guide piece assembly for an extraction or coal plough, comprising:

a guide piece including:

a generally U-shaped guide piece body configured to be inserted into a guide claw of the plough along an insertion direction, the guide piece body including a first leg, a second leg and a connecting portion extending between the first leg and the second leg; and a recess formed in the guide piece body to extend at an angle with respect to the connecting portion from an outer side of the connecting portion to an outer side of one of the first leg and the second leg; and a locking mechanism including:

a bolt configured to be received in a receiving bore formed in the guide claw and in the recess formed in the guide piece after installation of the guide piece in the guide claw, the bolt including an inner bore and an annular groove disposed adjacent to a first end of the pin; and a securing mechanism configured for engagement with the annular groove when the bolt is received in the receiving bore and the recess to secure the bolt in the receiving bore, to thereby prevent movement of the guide piece at least in a direction opposite to the insertion direction.

* * * * *